US009129764B2

(12) United States Patent
Hisada et al.

(10) Patent No.: US 9,129,764 B2
(45) Date of Patent: Sep. 8, 2015

(54) SWITCH DEVICE

(71) Applicant: KABUSHIKI KAISHA TOKAI RIKA DENKI SEISAKUSHO, Aichi (JP)

(72) Inventors: Masahito Hisada, Aichi (JP); Makoto Kobayashi, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 68 days.

(21) Appl. No.: 14/013,571

(22) Filed: Aug. 29, 2013

(65) Prior Publication Data

US 2014/0069787 A1 Mar. 13, 2014

(30) Foreign Application Priority Data

Sep. 7, 2012 (JP) ..... 2012-197428

(51) Int. Cl.
*H01H 19/06* (2006.01)
*H01H 23/06* (2006.01)

(52) U.S. Cl.
CPC ..... *H01H 23/06* (2013.01); *H01H 2300/01* (2013.01)

(58) Field of Classification Search
CPC ..... H01H 2021/00; H01H 2221/016; H01H 2223/044; H01H 2231/026; H01H 2300/00; H01H 2300/01; H01H 19/06; H01H 3/00; H01H 3/04; H01H 23/00; H01H 2223/00; H01H 2223/002; H01H 23/14
USPC ..... 200/302.3
See application file for complete search history.

(56) References Cited

U.S. PATENT DOCUMENTS

| | | | | |
|---|---|---|---|---|
| 5,493,087 | A | 2/1996 | Yoshida et al. | |
| 2004/0188235 | A1 | 9/2004 | Sugimoto et al. | |
| 2006/0186737 | A1 * | 8/2006 | Schmidt et al. | 307/10.1 |
| 2010/0025211 | A1 | 2/2010 | Saito | |

FOREIGN PATENT DOCUMENTS

| | | |
|---|---|---|
| JP | 59-139930 | 9/1984 |
| JP | 07-041894 | 7/1995 |
| JP | 2004-303427 | 10/2004 |
| JP | 2006-202691 | 8/2006 |
| JP | 2010-033994 | 2/2010 |

OTHER PUBLICATIONS

U.S. Appl. No. 14/013,620 to Masahito Hisada et al., which was filed Aug. 29, 2013.
Japanese Office action having mail date of Aug. 12, 2014.
Chinese Office Action for Application No. 201310393340.0 dated Mar. 20, 2015.

* cited by examiner

*Primary Examiner* — Edwin A. Leon
*Assistant Examiner* — Anthony R. Jimenez
(74) *Attorney, Agent, or Firm* — Greenblum & Bernstein, P.L.C.

(57) ABSTRACT

A switch device includes a lever. A switch body is arranged in the lever. The switch body supports the lever in a tiltable manner. At least one pusher is moved by contact with the lever when the lever is tilted. At least one switch unit is pushed when the pusher moves. A resiliently deformable sealing member is arranged between the lever and the switch body where air including dust may enter. The sealing member is separated from a location where the pusher comes into contact with the lever, and the sealing member is resiliently deformed when the lever is tilted.

5 Claims, 4 Drawing Sheets

SWITCH DEVICE

CROSS-REFERENCE TO RELATED APPLICATIONS

This application is based upon and claims the benefit of priority from prior Japanese Patent Application No. 2012-197428, filed on Sep. 7, 2012, the entire contents of which are incorporated herein by reference.

BACKGROUND OF THE INVENTION

The present invention relates to a switch device.

A switch device that opens and closes a power window of a vehicle is arranged in a passenger compartment of the vehicle (for example, refer to Japanese Laid-Open Patent Publication No. 2006-202691).

As shown in FIG. 6, such a switch device includes, for example, a lever 101, a pusher 103, a switch body 104, a manual switch 105, and an automatic switch 106.

The switch body 104 supports the lever 101 and the pusher 103 in a tiltable manner. Further, the manual switch 105 and the automatic switch 106 are arranged on the same plane separated from each other. The pusher 103 includes a lower left end 1031 opposing the manual switch 105. Further, the pusher 103 includes a lower right end 103*r* opposing the automatic switch 106.

When a user tilts the lever 101, a pushing portion 101*a* arranged in the lever 101 pushes the pusher 103. This slightly tilts the pusher 103 in the counterclockwise direction as viewed in the drawing. As a result, the manual switch 105 is pushed and activated. When the user further tilts the lever 101, the force from the pushing portion 101*a* slightly tilts the pusher 103 in the clockwise direction as viewed in the drawing. This pushes the automatic switch 106. Thus, the manual switch 105 and the automatic switch 106 are both activated.

As shown in FIG. 6, in the conventional switch device, a clearance is provided between the lever 101 and the switch body 104 to allow for tilting of the lever 101. As shown by arrow 110, air flows through the clearance into the switch device. Thus, dust, suspended in the air, may enter the switch device especially since the passenger compartment is a closed space. For example, when dust collects on the pusher 103 at a location that contacts the pushing portion 101*a*, frictional resistance increases between the pushing portion 101*a* and the pusher 103. Thus, a stronger force has to be applied to the lever 101 to operate the switch device. This makes it difficult to activate both of the manual switch 105 and the automatic switch 106. Further, the collection of dust in the switch device may also lead to other defects of the switch device.

SUMMARY OF THE INVENTION

One aspect of the present invention is a switch device including a lever. A switch body is arranged in the lever. The switch body supports the lever in a tiltable manner. At least one pusher is moved by contact with the lever when the lever is tilted. At least one switch unit is pushed when the pusher moves. A resiliently deformable sealing member is arranged between the lever and the switch body where air including dust may enter. The sealing member is separated from a location where the pusher comes into contact with the lever, and the sealing member is resiliently deformed when the lever is tilted.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment of a switch device will now be described in detail with reference to FIGS. 1 to 5. In the present embodiment, the switch device is a switch for a vehicle power window.

Figure 1:
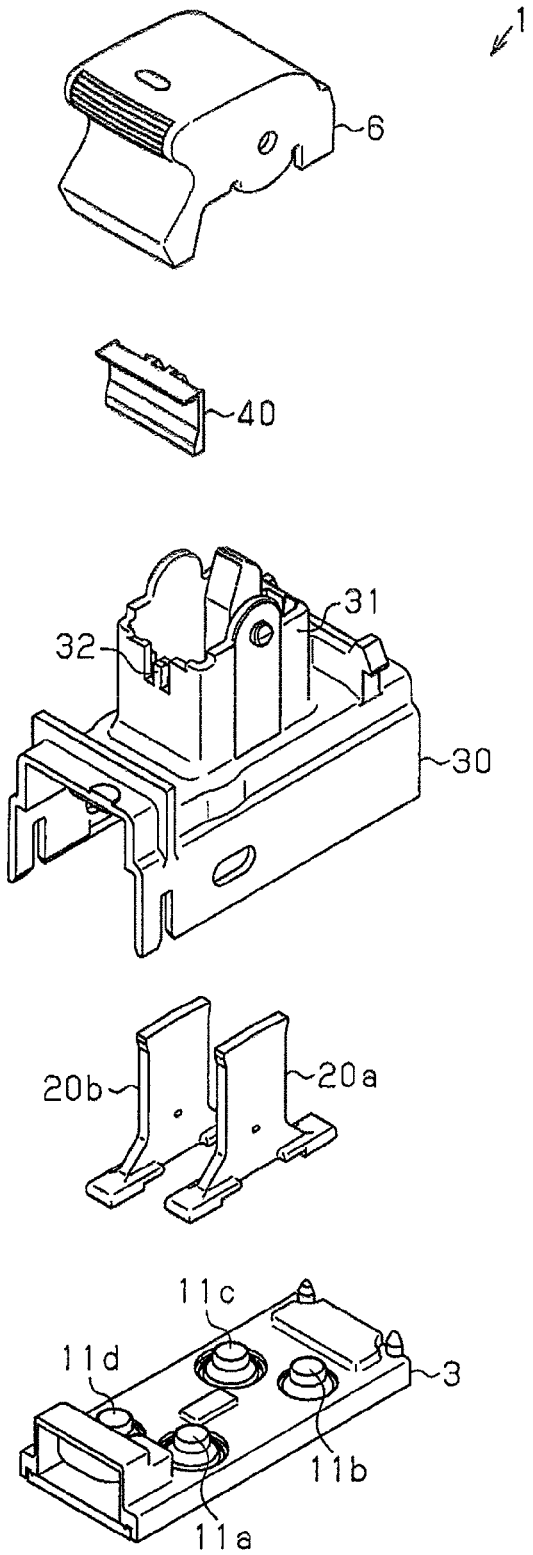
FIG. 1 is an exploded perspective view of a switch device according to one embodiment of the present invention.

Referring to FIG. 1, the switch device 1 includes a switch substrate 3, two pushers 20*a* and 20*b*, a switch body 30, a lever 6, and a sealing member 40.

The switch substrate 3 includes a plurality of switch units 11*a* to 11*d*. When the switch units 11*a* to 11*d* are pushed from the upper side, the switch units 11*a* to 11*d* are activated.

The switch body 30 is fixed to the switch substrate 3 and immovable relative to the switch substrate 3. The switch body 30 includes a main portion and a hollow holding portion 31, which includes a hole extending from the main portion. The lever 6 is fitted to the upper section of the holding portion 31 so as to be tiltable relative to the switch body 30. The lever 6 is box-shaped and includes an open bottom end. The lever 6, when fitted to the holding portion 31, covers the periphery and upper section of the holding portion 31.

Figure 2:
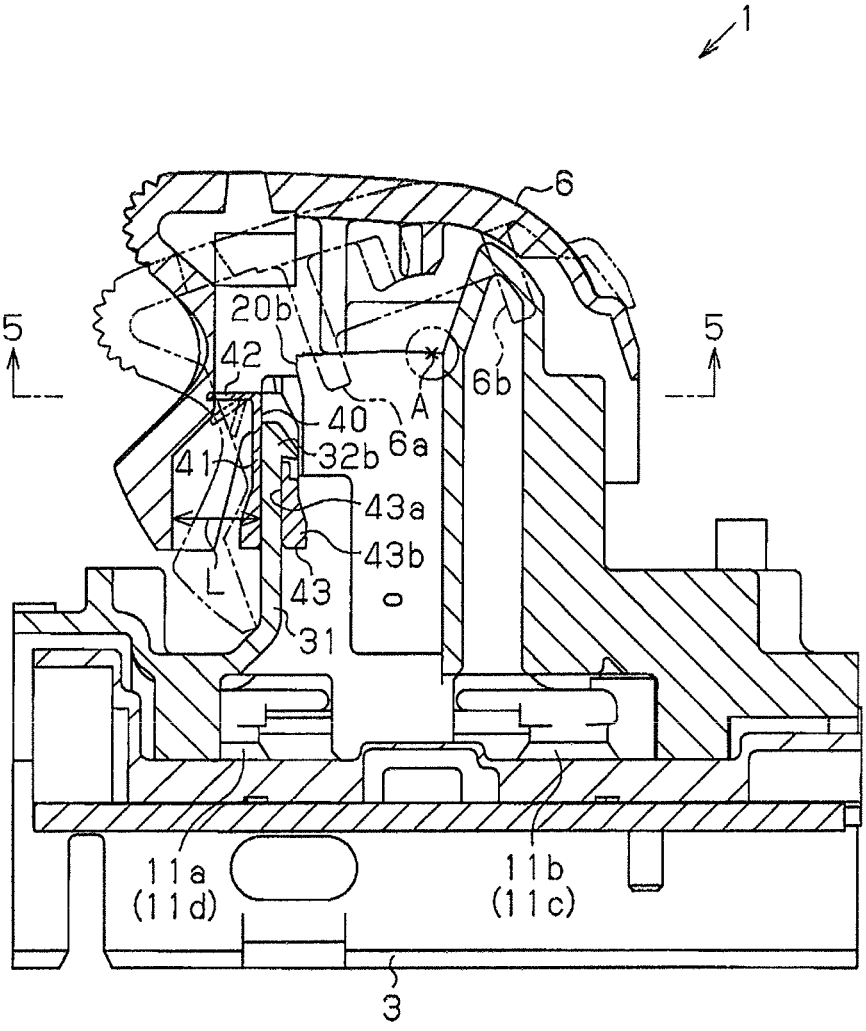
FIG. 2 is a cross-sectional view of the switch device shown in FIG. 1.

As shown by the broken lines in FIG. 2, the lever 6 is tilted about a pivot axis A. The lever 6 is at an initial position when arranged at the location shown by solid lines in FIG. 2. Operational force is applied to the lever 6 to tilt the lever 6 from the initial position. When the lever 6 becomes free from the operational force, an urging means (not shown) returns the lever 6 to the initial position.

A clearance L is formed between the lever 6 and the switch body 30 to allow for tilting of the lever 6. Air including dust may flow into the clearance L from the lower left side as viewed in FIG. 2.

When the lever 6 is tilted, the pushing portions 6*a* and 6*b* arranged in the lever 6 push upper surfaces of the pushers 20*a* and 20*b*. This moves the pushers 20*a* and 20*b* and pushes the switch units 11*a* to 11*d* that are arranged opposing the lower left and right ends of the pushers 20*a* and 20*b*, as viewed in FIG. 2. A controller (not shown) opens and closes the vehicle window in accordance with the activation and deactivation of the switch units 11*a* to 11*d*.

Figure 3:
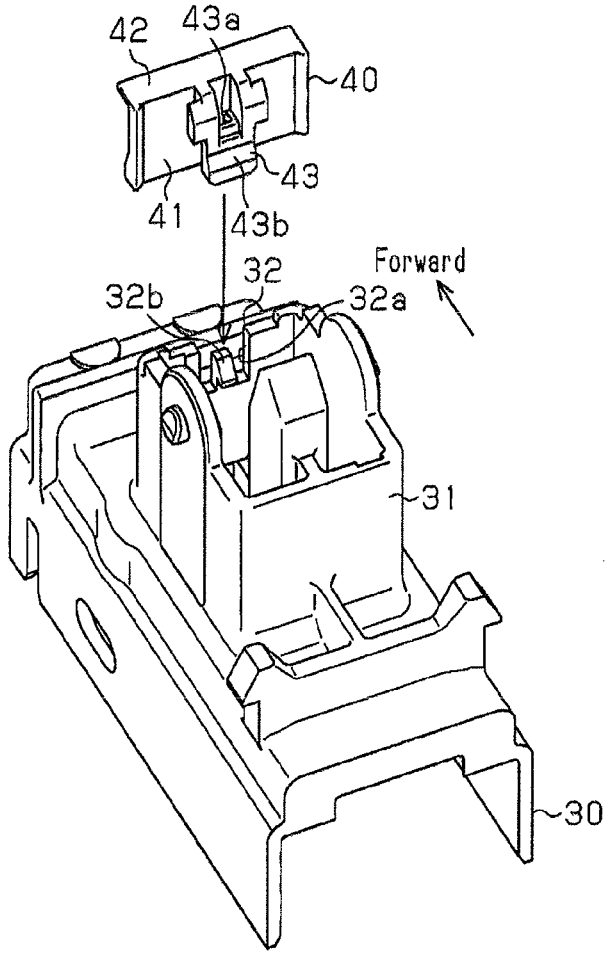
FIG. 3 is a perspective view of a switch body and a sealing member in the switch device shown in FIG. 1.

Referring to FIG. 3, a front end of the holding portion 31 includes a coupling section 32 that allows for the sealing member 40 to be coupled to the holding portion 31. The coupling section 32 includes a recess 32*a*, which is cut out from the holding portion 31, and a tab 32*b*, which upwardly extends from the bottom surface of the recess 32*a*. The tab 32*b* includes a hook-shaped end projecting into the holding portion 31.

The sealing member 40 is formed from an elastic material such as rubber. The sealing member 40 has a generally L-shaped cross-section and includes a main body 41, which has the form of a rectangular plate, and a seal 42, which extends in a direction orthogonal to the main body 41 and has the form of a rectangular plate. The seal 42 is thin so that the seal 42 does not interfere with the movement of the lever 6. The dimension of the main body 41 in the direction parallel to the short sides (widthwise direction) is greater than the dimension of the seal 42 in the direction parallel to the short sides (widthwise direction). The sealing member 40 includes a mounting portion 43, which is generally box-shaped and arranged on the outer surface of the main body 41.

Figure 4:
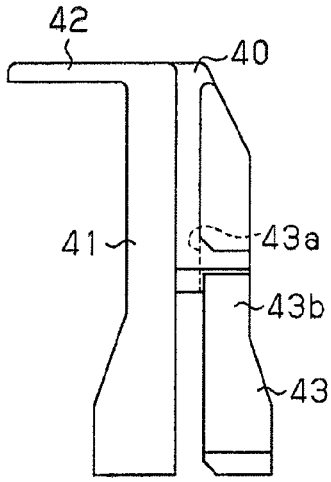
FIG. 4 is a side view of the sealing member shown in FIG. 3.

Referring to FIG. 4, the mounting portion 43 includes an insertion hole 43*a*, which extends through the mounting portion 43 in the vertical direction, and a clip 43*b*, which is located at a position separated from the main body 41 by a distance corresponding to the thickness of the holding portion 31. The tab 32*b* may be inserted through the insertion hole 43*a*.

Referring to FIG. 3, when coupling the sealing member 40 to the holding portion 31 of the switch body 30, the tab 32*b* is inserted through the insertion hole 43*a* of the mounting portion 43. This resiliently deforms the mounting portion 43. The resilient deformation of the mounting portion 43 allows for the tab 32*b* to enter the insertion hole 43*a*. Referring to FIG. 2, when the tab 32*b* is completely inserted through the insertion hole 43*a* of the mounting portion 43, part of the holding portion 31 is held between the clip 43*b* and the main body 41. Further, the mounting portion 43 is hooked to the distal end of the tab 32*b*. This suppresses removal of the sealing member 40 from the switch body 30.

Figure 5:
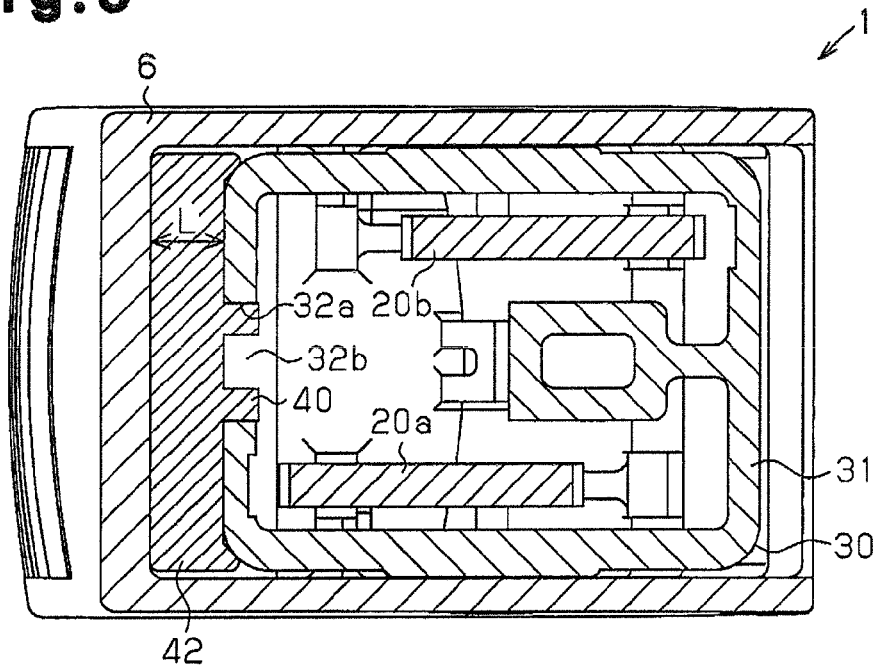
FIG. 5 is a cross-sectional view taken along line 5-5 in FIG. 2.
Figure 6:
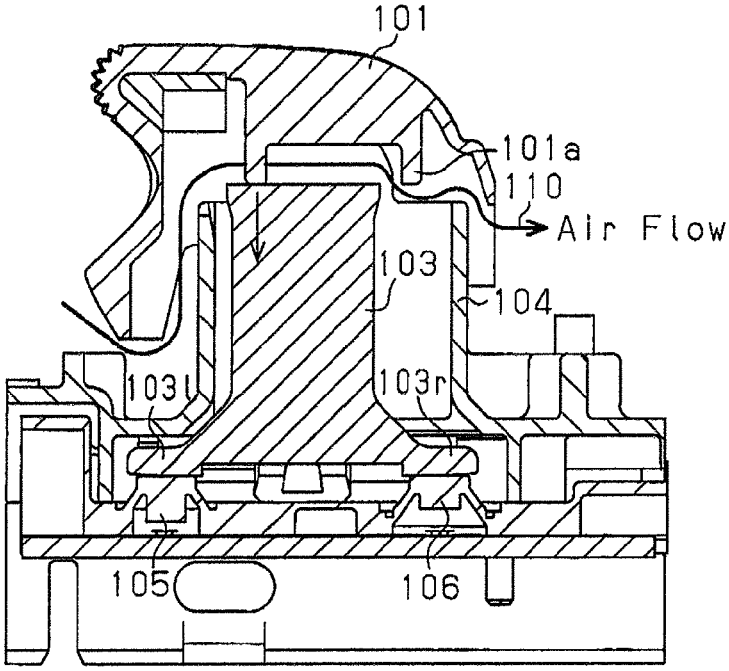
Fig. 6 (Prior Art)
FIG. 6 is a cross-sectional view showing a switch device of the prior art.

FIG. 5 is a cross-sectional view taken along line 5-5 in FIG. 2. As shown in FIG. 5, the seal 42 of the sealing member 40 is located between the inner surface of the lever 6 and the outer surface of the switch body 30 to close the clearance L. In this manner, the sealing member 40 seals the clearance L so that air including dust does not flow into the switch device 1 from the clearance L.

The operation of the switch device 1 will now be described.

As shown by the broken lines in FIG. 2, when the lever 6 is downwardly tilted from the initial position, the seal 42 is resiliently bent at a portion proximal to its basal end (end connected to the main body 41) in conformance with the movement of the lever 6. Under this situation, the distal end of the seal 42 remains in contact with the inner surface of the lever 6. Thus, the sealing member 40 keeps the clearance L sealed.

The present embodiment has the advantages described below.

(1) The sealing member 40 is arranged between the lever 6 and the switch body 30 (holding portion 31) at a location where dust may enter suspended in air. This location is separated from where the pushers 20*a* and 20*b* come into contact with the lever 6 (pushing portions 6*a* and 6*b*). That is, the sealing member 40 is arranged in the clearance L that is located at the upstream side of where the pushers 20*a* and 20*b* come into contact with the lever 6 (pushing portions 6*a* and 6*b*) with respect to the direction in which air flows into the switch device 1. Thus, the sealing member 40 suppresses the entrance of dust into the switch device 1, in particular, to the location where the pushers 20*a* and 20*b* come into contact with the lever 6.

Since the collection of dust between the pushing portions 6*a* and 6*b* and the pushers 20*a* and 20*b* is suppressed, there is no need to apply a stronger force to the lever 6. Further, wear resulting from dust does not occur in the pushers 20*a* and 20*b*. This maintains the operability of the switch device 1 over a long period. In addition, other defects of the switch device 1 are suppressed that would occur when dust enters the switch device 1.

(2) The mounting portion 43 of the sealing member 40 is mounted on the coupling section 32 of the switch body 30. Thus, the sealing member 40 may easily be mounted on the switch body 30 without using an adhesive agent or the like.

(3) The seal 42 is thin enough to allow for deformation when the lever 6 is tilted. Thus, the sealing member 40 is resiliently deformable in conformance with the tilting of the lever 6. Further, the sealing member 40 does not increase the force needed to operate the lever 6. Accordingly, the sealing member 40 does not affect the operability of the switch device 1.

(4) The sealing member 40 is formed integrally from rubber. This facilitates molding of the sealing member 40.

It should be apparent to those skilled in the art that the present invention may be embodied in many other specific forms without departing from the spirit or scope of the invention. Particularly, it should be understood that the present invention may be embodied in the following forms.

In the above embodiment, the sealing member 40 is formed integrally from rubber but may be formed from another elastic material such as urethane. Further, the sealing member 40 may be changed. For example, when forming the sealing member 40 from a highly flexible material such as urethane, the sealing member 40 may be box-shaped. In this case, one surface of the box-shaped sealing member 40 may be adhered to the outer surface of the switch body 30 by an adhesive agent. This simplifies the form of the sealing member 40.

In the above embodiment, the sealing member 40 is formed integrally from rubber. Instead, the seal 42 may be formed from rubber, and the main body 41 and the mounting portion 43 may be formed from a material differing from that of the seal 42 such as a synthetic resin (plastic). In this case, the seal 42 and the main body 41 are formed to be connectable to each other. The formation of the mounting portion 43 from synthetic resin suppresses wear of the mounting portion 43.

In the above embodiment, the coupling section 32 of the switch body 30 may be omitted. In this case, the holding portion 31 is held between the clip 43*b* and the main body 41. This allows for the sealing member 40 to be mounted on the switch body 30. In this structure, there is no need to change the form of the switch body 30. This facilitates retrofitting of the sealing member 40 to a switch device.

In the above structure, the structure of the switch device 1 is only one example. There is no limitation to the structure of the above embodiment as long as there is a clearance between the lever 6 and the switch body 30.

In the above embodiment, the switch device 1 is used for a vehicle power window but may be used to control other subjects.

The present examples and embodiments are to be considered as illustrative and not restrictive, and the invention is not to be limited to the details given herein, but may be modified within the scope and equivalence of the appended claims.

What is claimed is:

1. A switch device comprising:

a lever;

a switch body arranged in the lever, wherein the switch body supports the lever in a tiltable manner;

at least one pusher moved by contact with the lever when the lever is tilted;

at least one switch unit pushed when the pusher moves; and a resiliently deformable sealing member arranged between the lever and the switch body where air including dust may enter, wherein the sealing member is separated from a location where the pusher comes into contact with the lever, and the sealing member is resiliently deformed when the lever is tilted, the sealing member has a generally L-shaped cross-section and includes a main body defined as a rectangular plate, and a seal, which extends in a direction orthogonal to the main body and is defined as a rectangular plate, the switch body includes a holding portion having an upper end and a peripheral surface, the lever is coupled to the upper end of the holding portion, the peripheral surface of the holding portion includes a coupling section opposed to the lever, and the coupling section allows for the main body of the sealing member to be coupled to the holding portion.

2. The switch device according to claim 1, wherein the sealing member includes a mounting portion mounted on the switch body.

3. The switch device according to claim 1, wherein the sealing member includes a basal end and distal end, the basal end is fixed to the switch body, the distal end contacts the lever, and the distal end is thin enough to be resiliently deformable when the lever tilts.

4. The switch device according to claim 1, wherein the sealing member is formed integrally from rubber.

5. The switch device according to claim 2, wherein the coupling section is provided with a tab including a hook-shaped end projecting into the holding portion, the mounting portion includes an insertion hole allowing for insertion of the tab, and the tab is inserted through the insertion hole and hooked to the mounting portion.

* * * * *